US006886487B2

(12) United States Patent
Fischer, III

(10) Patent No.: US 6,886,487 B2
(45) Date of Patent: May 3, 2005

(54) THRUSTER APPARATUS AND METHOD FOR REDUCING FLUID-INDUCED MOTIONS OF AND STRESSES WITHIN AN OFFSHORE PLATFORM

(75) Inventor: Ferdinand J. Fischer, III, Houston, TX (US)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 10/298,998

(22) Filed: Nov. 18, 2002

(65) Prior Publication Data

US 2003/0131777 A1 Jul. 17, 2003

Related U.S. Application Data

(63) Continuation of application No. 09/777,142, filed on Feb. 5, 2001, now abandoned

(60) Provisional application No. 60/180,371, filed on Feb. 4, 2000.

(51) Int. Cl.[7] ..... B63B 21/00

(52) U.S. Cl. ..... 114/230.1; 405/211

(58) Field of Search ..... 114/230.1, 144 B; 405/211

(56) References Cited

U.S. PATENT DOCUMENTS

| | | | | |
|---|---|---|---|---|
| 3,327,668 A | * | 6/1967 | Von Schultz | 114/265 |
| 3,508,512 A | * | 4/1970 | Desrayaud et al. | 114/144 R |
| 3,844,242 A | * | 10/1974 | Sernatinger et al. | 114/144 B |
| 3,965,840 A | * | 6/1976 | Blumberg | 114/144 B |
| 4,089,287 A | * | 5/1978 | Kranert et al. | 114/144 B |
| 6,148,751 A | * | 11/2000 | Brown et al. | 114/67 A |

* cited by examiner

*Primary Examiner*—Sherman Basinger
(74) *Attorney, Agent, or Firm*—William E. Hickman

(57) ABSTRACT

Thrusters in communication with a feedback control system are provided on a cylindrical offshore marine member, such as a spar, for reducing and/or controlling vortex-induced-vibrations, low-frequency drift oscillations due to random waves, and low-frequency wind induced resonant oscillations. The thrusters are provided thrust instruction from the feedback control system based on marine member displacement and current velocity.

12 Claims, 9 Drawing Sheets

THRUSTER APPARATUS AND METHOD FOR REDUCING FLUID-INDUCED MOTIONS OF AND STRESSES WITHIN AN OFFSHORE PLATFORM

RELATED APPLICATION DATA

This application is a continuation of and claims priority of U.S. application Ser. No. 09/777,142, filed Feb. 5, 2001, now abandoned, entitled "Thruster Apparatus and Method for Reducing Fluid-Induced Motions of and Stresses within an Offshore Platform", which claims priority from U.S. Provisional Application No. 60/180,371, filed Feb. 4, 2000.

BACKGROUND OF THE INVENTION

1. Field of the Invention

The present invention relates to methods and apparatus of reducing and/or controlling vortex-induced-vibrations ("VIV") due primarily to ocean and other currents, low-frequency drift oscillations due to random waves, and low frequency wind-induced resonant oscillations of moored offshore platforms and other marine elements. In another aspect, the present invention relates to methods and apparatus for the use of thrusters for the control of VIV, low-frequency drift oscillations due to random waves, and low-frequency wind induced resonant oscillations. In even another aspect, the present invention relates to methods and apparatus for the active control of VIV, low frequency drift oscillations due to random waves, and low-frequency wind induced resonant oscillations. In still another aspect, the present invention relates to use of thrusters in combination with feedback control for the active control of VIV, low-frequency drift oscillations due to random waves, and low-frequency wind-induced resonant oscillations.

2. Description of the Related Art

The development of oil and gas reserves in deep water (over 1300 feet deep) and ultra-deep water (over 2000 feet deep) has required the design and construction of floating drilling and production platforms or vessels that do not rest on the ocean bottom. These floating platforms include but are not limited to tension leg platforms, spars, semi-submersibles, and Floating Production, Storage and Off-loading (FPSO) vessels.

The floating platforms or vessels are moored to the sea floor, usually with conventional catenary mooring lines. One of the problems faced by these vessels is that they must be maintained in a relatively small circle of movement above the sea floor, called the watch circle, to avoid breaking drilling equipment or production risers extending from the vessel to the sea floor.

Hampering maintenance of a small watch circle for the floating platforms and vessels is the effects of ocean currents and random waves and wind on those structures. Ocean currents flowing past the structures can cause vortex-induced vibrations of those structures. Risers, drilling equipment and mooring lines may also develop VIV. In addition, random waves and wind striking the structures can cause low-frequency oscillations of the structures, which can move the structures relative to the sea floor and stress connections with the sea floor.

Methods and equipment developed to reduce vibrations and oscillations of these floating structures include attaching strakes or shrouds to the structures to reduce VIV. Methods and equipment developed to reduce the rolling and transverse swaying of FPSO vessels include modified "bilge keels", which are perpendicular plates extending from the bottom, or bilge, of the ship.

In spite of advancements in the art, there is a need in the art for methods and apparatus for controlling VIV and low frequency oscillations of marine elements.

There is another need in the art for methods and apparatus for controlling VIV and low frequency oscillations of marine elements that do not suffer from the disadvantages of the prior art.

There is even another need in the art for methods and apparatus for controlling VIV and low frequency oscillations of marine elements that can be activated only when the vibration or other oscillation is occurring.

There is still another need in the art for methods and apparatus for controlling VIV and low frequency oscillations of marine elements that can be modulated for the extent of the vibration or other oscillation.

These and other needs in the art will become apparent to those of skill in the art upon review of this specification, including its drawing and claims.

SUMMARY OF THE INVENTION

It is an object of the present invention to provide methods and apparatus for controlling VIV and low-frequency oscillations of marine elements.

It is another object of the present invention to provide methods and apparatus for controlling VIV and low-frequency oscillations of marine elements that do not suffer from the disadvantages of the prior art.

It is even another object of the present invention to provide methods and apparatus for controlling VIV and low frequency oscillations of marine elements that can be activated only when the vibration or other oscillation is occurring.

It is still another object of the present invention to provide methods and apparatus for controlling VIV and low frequency oscillations of marine elements that can be modulated for the extent of the vibration or other oscillation.

According to one embodiment of the present invention there is provided a method for protecting an offshore marine member from vibration caused by a current flowing on a flow path past said member at a current velocity. The method further includes using one or more thrusters, monitoring the current velocity and the marine member for displacement.

According to another embodiment of the present invention, there is provided a method for protecting a moored vessel from low frequency oscillations caused by waves or wind striking the vessel along a flow path, wherein the vessel comprises one or more thrusters. The method further includes monitoring the vessel for displacement; and activating at least one of the thrusters.

According to even another embodiment of the present invention, there is provided an apparatus for protecting an offshore marine member from the vibration or oscillation effects of a current flowing on a flow path past said member. The apparatus generally includes one or more thrusters positioned to provide thrust to the member. The apparatus also includes a displacement sensor positioned to monitor displacement of the member. The apparatus even further includes a current velocity sensor positioned to monitor the current velocity. The member still further includes a logical controller in communication with the displacement sensor and the current velocity sensor, and in communication with the one or more thrusters, wherein the controller includes instructions for generating a thruster control signal for the thruster.

According to still another embodiment of the present invention, there is provided an apparatus for protecting a moored vessel from low frequency oscillations caused by waves or wind striking the vessel along a flow path. The apparatus includes one or more thrusters positioned to provide thrust to the vessel; a displacement sensor positioned to monitor displacement of the vessel; and a logical controller in communication with the displacement sensor and in communication with the one or more thrusters, wherein the controller includes instructions for generating a thruster control signal for the thruster.

DETAILED DESCRIPTION OF THE INVENTION

Figure 1A:
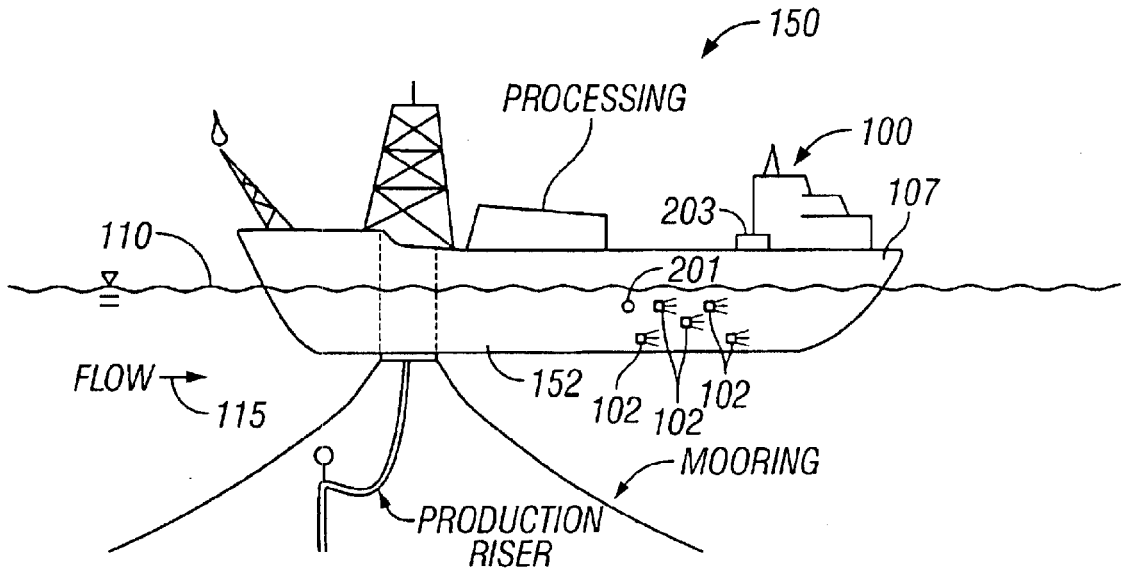
FIG. 1*a* is an illustration of a moored floating, production, storage and offloading vessel (FPSO) 150 with thruster system 100 including thruster units 102.

Referring first to FIG. 1*a*, there is illustrated a moored floating production, storage and offloading vessel (FPSO) 150 floating in ocean 110 with current 115 flowing past FPSO 150. Shown is thruster system 100 comprising individual thrusters 102 attached on the hull 152 near stern 107 of vessel 150 in ocean 110. Also positioned on hull 152 is sensor/monitors 201 in communication with controller 203 and thrusters 102.

Figure 1B:
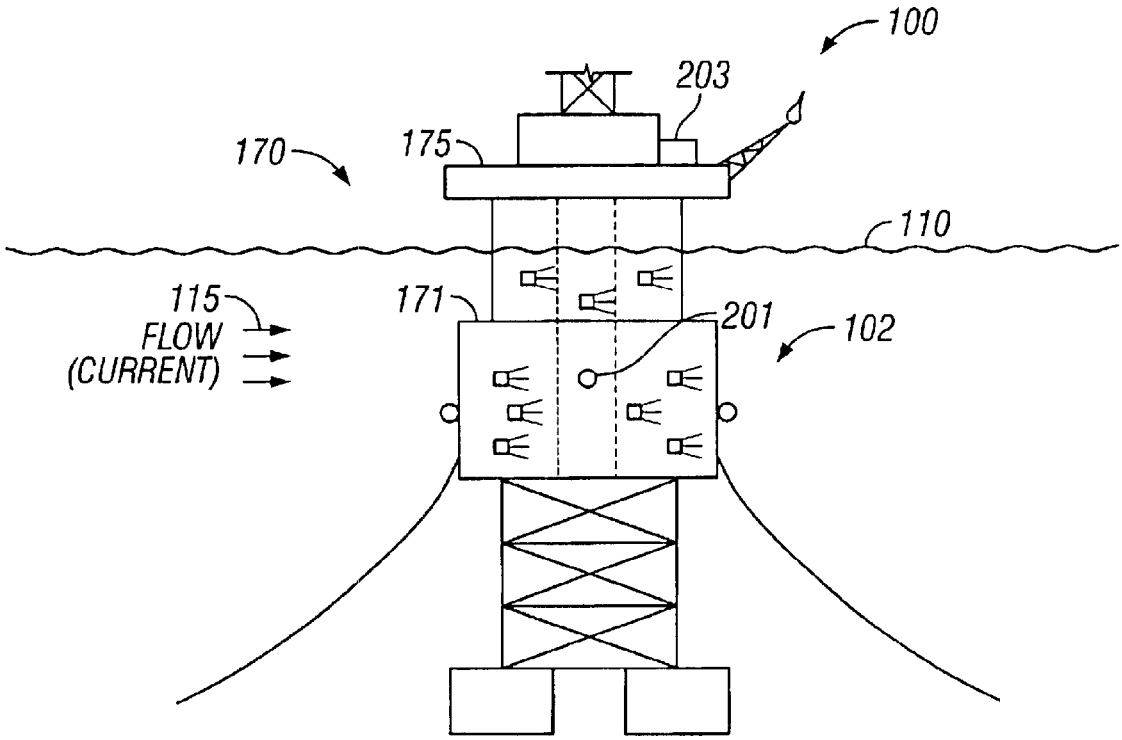
FIG. 1*b* is an illustration of a moored spar platform 170 with thruster system 100 showing a group of individual thrusters 102.

Referring next to FIG. 1*b*, there is shown spar 170 with deck 175 floating in ocean 110 with thruster system 100 installed. Current 115 is shown flowing past spar 170. Thruster system 100 comprises a group of individual thrusters 102 attached under ocean 110 to hull 171 of spar 170. Also attached to hull 171 under ocean 110 is monitor/sensors 201 in communication with thruster controller 203 and thrusters 102.

Figure 16:
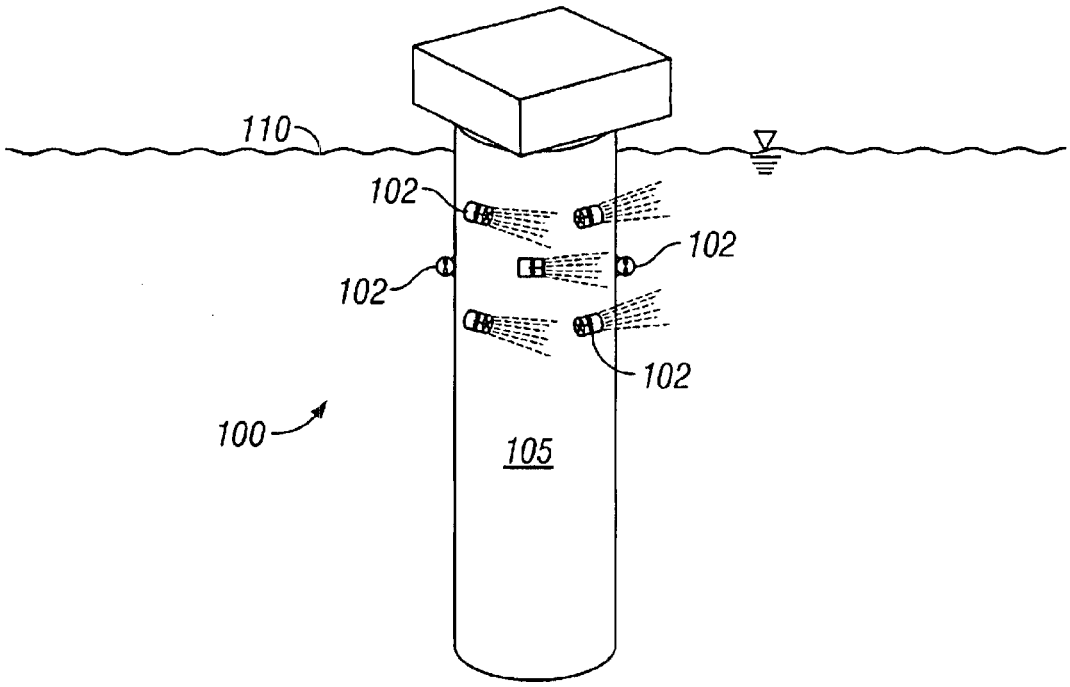
FIG. 16 is an illustration of a proposed arrangement of thruster units on a spar.

The present invention utilizes thrusters for the active control of vortex induced vibrations, low-frequency drift oscillations due to random waves, and low-frequency wind-induced resonant oscillations of moored, deepwater floating platforms, e.g. spars, tension-leg platforms (TLP), ship-shape floaters, etc. Referring now to FIG. 16, there is shown spar 105 in ocean 110, onto which is provided thruster system 100, which includes one or more thrusters 102.

These thrusters for control of spar VIV can eliminate helical strakes, spar-hull gaps, and step changes in spar-hull diameter that have been proposed for the passive mitigation of spar VIV. Furthermore, mooring requirements should be less than for straked spars. For wave- and wind-induced low-frequency motions, there currently are no means of mitigation. The active control apparatus and methods of the present invention provide such a means and also result in reduced mooring requirements. The active control apparatus and methods of the present invention are also applicable to moored floating aquatic vessels, such as TLPs, moored semi-submersibles including spars, and spread-moored tankers and ships that undergo low-frequency wave- and wind-induced oscillations that place additional requirements on their respective mooring systems.

In the practice of the present invention, any suitable type of thruster may be utilized as thruster 102, subject of course, to the limitations of that particular thruster. The parameters (i.e., geometry, size, shape, weight and the like) of the platform, spar, semi-submersible, spread moored tankers, or other moored object, being protected will also have a bearing on the type of thruster to be utilized.

For example, while hydraulic thrusters generally have no depth limitations, consideration must be given to their limited power ratings (generally <1,000 hp), and that they generally require a great deal of maintenance.

On the other hand, propeller-type thrusters have depth limitations, and typically, they operate best at depths in the range of about 10 m to about 25 m, preferably in the range of about 10 m to about 15 m. At depths greater than about 25 m, seals around the propeller shaft leak or rupture. Since this depth location on most spar hulls is above that spar's center-of-gravity, the force from the thrusters will induce small, slowly varying pitch and roll moments. However, the period of these moments (3 to 5 min for the surge and sway motions being controlled) is much longer than the pitch and roll natural periods and, therefore, no significant dynamic-pitch/roll response is anticipated.

In the practice of the present invention, thrusters may be azimuthing or fixed-direction.

While azimuthing thrusters are desirable because they can provide a force in any direction, disadvantages include: installation at the bottom of a spar is difficult to due to depth limitations; when installed adjacent the spar hull their effectiveness may be compromised for certain headings due to flow interference; and the cost of an azimuthing thruster is typically around twice that of a fixed-direction thruster. Thus, preferably the thrusters of the present invention are fixed-direction.

Again, the particular thruster design will depend on the object being protected. For instance, for the spar as modeled in the example, the preferred thrusters are fixed-direction nozzle thrusters. The preferred nozzle for the example is symmetric (fore and aft) and significantly increases the thrust delivered by the propeller for a given horsepower. Generally the thrusters are located adjacent to the hull (solid surface) of the spar with their propeller axis tangent to (but outboard of) the spar surface to minimize flow interference. While the thrusters of the illustrated example are driven by electric motors, any suitable motor may be utilized, including hydrocarbon powered motors.

In order to achieve variable thrust one can either use a fixed-pitch propeller with a variable-speed motor or a variable-pitch propeller with a constant-speed motor. It is much more economic to use a variable-pitch propeller with a motor of constant speed. The variable-pitch propeller is reliable and the additional cost introduced is small.

A wide range of thrust may be delivered by the thrusters utilized in the present invention, and will depend upon the type of object being protected, and the type of vibrations or oscillations being encountered. As a non-limiting example, thrust in the range of about 22 lbf/hp to about 30 lbf/hp could be utilized. Of course, the exact value depends on the flow velocity at the propeller, the propeller diameter and pitch, and the propeller rpms.

For a tunnel thruster, non-limiting examples of values are between 23 and 25 lbf/hp, while for the nozzle thruster, which is preferred for the spar of the example, an approximate value is 28 lbf/hp.

While not required to operate the invention, it is preferred to utilize some redundant thrusters, for example, to provide two extra thrusters (one extra thruster in each direction).

The thrusters utilized must have appropriate response times. Generally, it takes about 10 to 20 sec to build full thrust from rest. In particular, thruster response time depends on the propeller size, generally requiring 10 seconds for "small" propellers and 20 seconds for "large" propellers. The propellers must also provide a sinusoidal or a nearly square-wave periodic thrust with periods in the range of about 3 minutes to about 5 minutes, which are typical surge and sway periods for previously mentioned moored floating platforms.

Any suitable arrangement or configuration of thrusters may be utilized, provided that the desired protection from the vibrations/oscillations is provided. It is generally preferred to provided thrusters at several different depths with a maximum of four thrusters at any given depth. In a preferred embodiment, four thrusters are utilized and they are positioned about 90 degrees apart. While more than four thrusters may be utilized at a given depth, it is important to consider whether destructive interference might result from use of more than four thrusters at any given depth.

For the thrusters proposed for the modeled example, the non-dimensional thrust coefficient of 0.15 indicates the required thrust of 453,506 lbf in each (any) direction of motion. In order to obtain the power required, the 28 lbf/hp conversion for nozzle thrusters is used, yielding a requirement of 16,196 hp in each direction. For the model example, it is proposed to select either 3000-hp units or 4000-hp units.

It should also be noted that the thrusters of the present invention could also be used to supplement the station-keeping capability of the spar mooring system.

While the thruster system of the present invention may be manually controlled, the thruster system of the present invention may also include a feedback control system.

Figure 17:
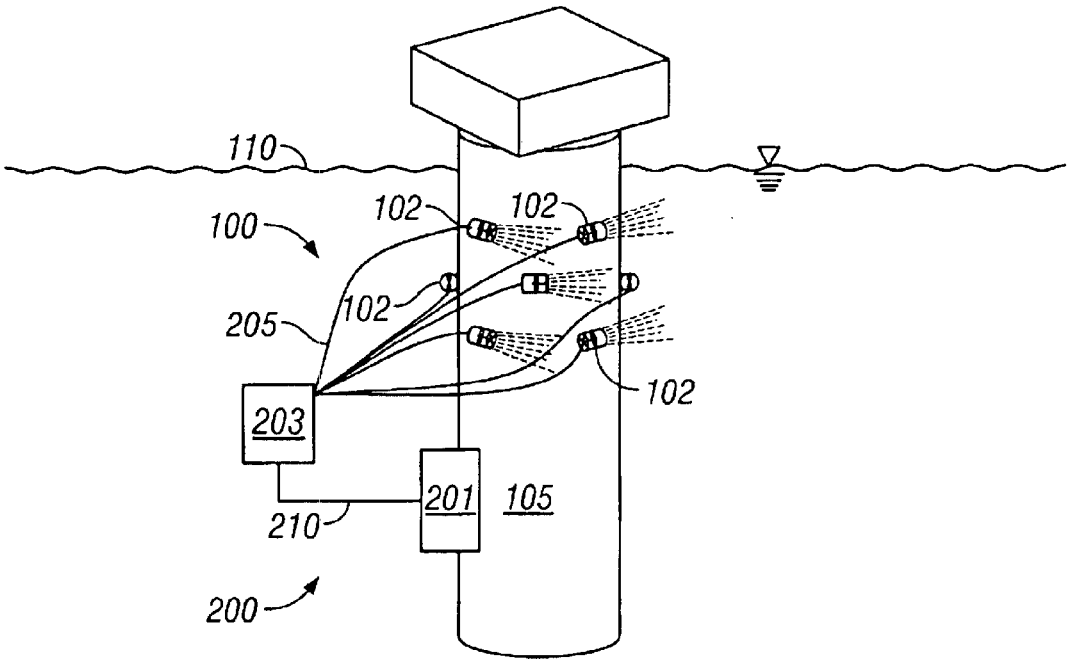
FIG. 17 is an illustration of a proposed arrangement of thruster units and feedback control system on a spar.

Referring now to FIG. 17, there is shown spar 105 in ocean 110, supporting thruster system 100 having one or more thrusters 102 positioned on spar 105. Also shown in FIG. 17 is control system 200, including sensors/monitors 201 in communication with controller 203 via communication connection 210, and including communication connection 205 between controller 203 and thrusters 102.

It should be understood that communication connections 205 and 210 may be any suitable wire, cable, or wireless connection that will allow the necessary communication of data/signal between monitor/sensors 201 and controller 203, and between controller 203 and thrusters 102.

The monitor/sensors 201 of the present invention may comprise one or more sensors and will generally provide data regarding the free stream fluid velocity (i.e., the water current velocity), and the displacement of the spar. Monitor/sensor 201 may be placed at or near spar 105, or may be remote sensors (such as satellite monitoring of the spar for displacement, or even a GPS type of system).

Controller 203 is generally any suitable logical controller device, including but not limited to microprocessors, minicomputers, personal computers, mainframes, and the like. Software or other logical instructions are provided so that controller 203 can process the data from monitor/sensors 201 and provide the appropriate instruction to thrusters 102. Any suitable type of proportional, integral, or differential controller, or any combination thereof, may be utilized. A general discussion of controllers may be found in the $5^{th}$ edition(and subsequent editions) of The Chemical Engineers' Handbook, Perry, R. H. and C. H. Chilton, Editors, Section 22, Process Control, with the $5^{th}$ and subsequent editions herein incorporated by reference. Any suitable model for predicting vibration or oscillation behavior may also be utilized. Controller 203 may be positioned at or near spar 105, or may be remotely located.

In operation, monitor/sensors 201 provide current velocity and displacement data to controller 203, which in turn provides instruction signals to thrusters 102.

EXAMPLES

Computer simulation was employed to illustrate the usefulness of the present invention.

Specifically, active-control technology of the present invention to mitigate long-period (100–300 sec) motions of spar platforms was modeled. The technical feasibility and cost effectiveness of using a thruster-based active-controlled system was studied. Only Vortex Induced Vibrations (VIV), which has received considerable attention by the offshore petroleum industry, was considered, but the thrusters of the present invention can contend with wave drift forces as well as low-frequency wind excitation.

In this computer modeled example, two events were analyzed: the 5-year loop current and the 100-year loop current.

Computational Fluid Dynamics (CFD) software (Professor John Kallinderis, University of Texas, Austin) was utilized to compute the flow around a cylinder (used as an approximation for a spar or other cylindrical marine object) in a uniform stream. The fluid forces were then used to obtain the unsteady motions of the spar. The effect of the thrusters was included as an external force, which is a function of time.

Several different control strategies were investigated. It was found that the most effective strategy is D-control, that is, when the thruster provides a force proportional to the spar velocity. In that case the motions can be suppressed to 5% of the spar diameter. This is generally superior to the control that can be achieved by prior-art technologies such as helical strakes. Furthermore, the resulting in-line drag force on the spar, and similar cylindrical structures, is at least 20% less than that for a fully straked spar.

This example models the employment of marine thrusters for the active control of: (1) vortex-induced vibrations (VIV), (2) low-frequency, wave-induced drift oscillations, and (3) low-frequency, wind-induced resonant oscillations of moored spar platforms. This is not to be confused with dynamic positioning of unmoored vessels. It is assumed here that a mooring system that contends with the large, "steady" environmental loads exists and, further, that the active control contends solely with troublesome, large-amplitude, resonant responses due to a variety of small-amplitude environmental forces, i.e., vortex-shedding forces, second-order wave-drift forces and slowly varying wind forces. Although the responses can be large (due to low damping and dynamic excitation at or near resonance), the exciting forces are small relative to extreme, steady environmental forces. Hence, the power requirements for thrusters are quite small relative to power requirements for a full-time station-keeping system. It is also envisaged that the control logic can be quite straightforward since the troublesome responses are largely periodic and somewhat theoretically predictable.

General Discussion of Example Modeling Procedures

Computation of Vortex-Induced Forces on a Spar Using CFD and Associated Spar Responses

Formulation of the Problem

Figure 2:
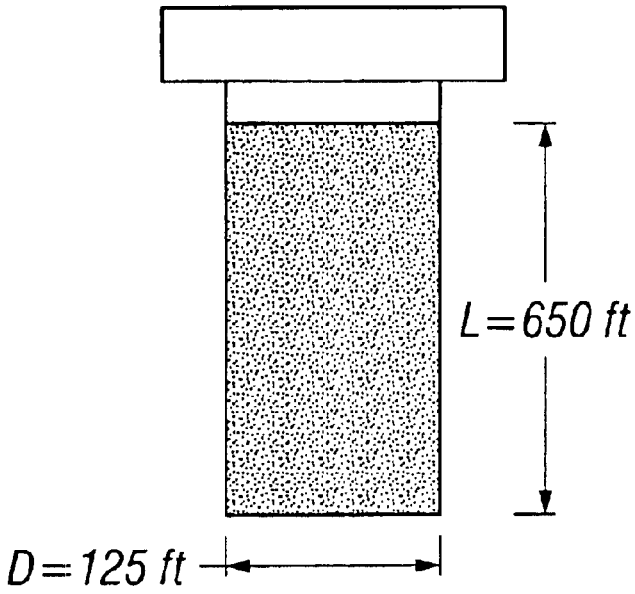
FIG. 2 is an schematic representation showing the main dimensions of the spar platform

Referring now to FIG. 2, there is shown the spar geometry, with the draft of the spar being 650 ft and the diameter being 125 ft. The spar platform is modeled as a spring-mounted, vertical, surface-piercing cylinder which is allowed to respond (translate) freely to the surrounding uni-directional current field. The natural periods in surge and sway are 200 sec. Forces associated with the shedding of vortices from the spar hull are assumed to be the only (unwanted) source of spar excitation. The periods of interest for these forces are typically around 3 to 5 minutes (200–300 seconds) since these correspond to the sway natural periods of representative spar platforms currently being introduced into the Gulf of Mexico.

It is well documented that sufficiently large loop currents exist to generate vortex shedding at these periods (frequencies.) Spar VIV (oscillatory translations) are predominantly in the direction transverse to the current flow, although some small in-line motions are usually also present. The resulting combined motion has been likened to a figure eight (8) oriented to the surface of the water as the number 8 is oriented to the surface of a page. The path of this combined motion of the spar is in response to a current flowing toward one side of the figure 8 path of motion. It was deemed sufficient in this study to focus on these horizontal translations (surge and sway) because their excitation (and natural) periods are significantly different than those for the other spar degrees-of-freedom. In other words, pitch, roll, etc. dynamic motions should not be induced.

In order to model the VIV phenomenon, two distinct issues were addressed: (1) the viscous fluid flow, including separation, around the cylinder; and (2) the dynamic response of the spar.

Figure 3:
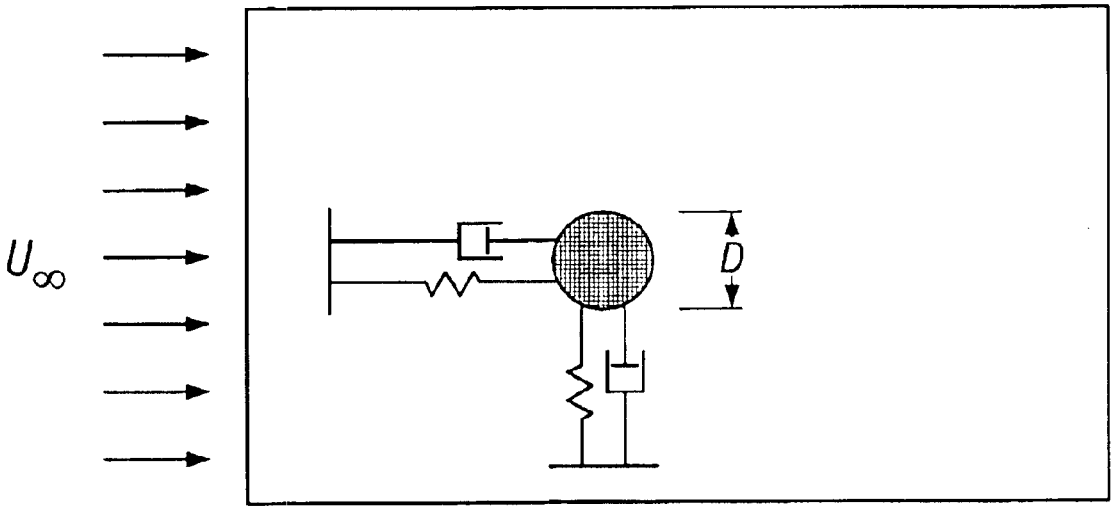
FIG. 3 is a schematic representation of the mathematical model of each section of the spar as an elastically mounted circular cylinder subjected to a uniform free-stream current.

These two problems are coupled and must be solved "simultaneously." The fluid-flow problem is solved using CFD software, which permits the efficient numerical solution of the Navier-Stokes equations, which govern viscous fluid flow. The spar dynamics are modeled as a mass-spring-dashpot system capable of two degrees-of-freedom (2DOF). These translational degrees-of-freedom are surge (in-line) and sway (transverse). The "spring" represents the spar mooring system. Note that both of these problems are solved in two dimensions as illustrated in FIG. 3.

Mathematically, there are many different methods for simulating such coupled fluid-structure interaction problems. In the present example the fluid flow problem is solved first at each instant of time t. After obtaining the fluid pressure and the sectional lift coefficient, a current profile which consists of three constant-velocity regimes is assumed.

This current profile is used to calculate the forces exerted on the spar by the fluid. This force is used as input in the spar dynamics model to perform a dynamic analysis over one time step and update the position of the spar. In the next time step the entire procedure is repeated.

The effect of the thrusters is included as a dynamic, external-force term in the spar equations of motion. This thruster force acts in the direction transverse to the free stream, which is where the dynamic response of the spar is more severe. Given the very fast response time of the thrusters, this external-force term can be an arbitrary function of time.

Model Assumptions

VIV Simulations for an Isolated Cylinder

The model used was a single elastically mounted cylinder which is allowed to respond freely to the surrounding flow-field shown in FIG. 3. To simulate the VIV phenomenon, a structural response model is required which accommodates the displacement and velocity of each body as it responds to the surrounding flow field. Consequently, the incompressible fluid-mechanics solution procedure must be coupled with a rigid-body structural response in order to adequately resolve the flow-structure interaction. If each structure is treated as a rigidly mounted elastic body moving in the transverse direction only, the resulting equation of motion is:

$$m\ddot{y}+c\dot{y}+ky=f_y(t) \tag{1}$$

where m is the mass per unit length of the body, c is the damping coefficient, k is the stiffness coefficient, and y denotes the transverse location, or displacement, of the body centroid. The right-hand side of the equation (1) contains the time-dependent external force, f(t), which is computed directly from the fluid flow field. To include a feedback control mechanism, the right hand side of equation (1) is augmented to include a thruster force $f_{thrust}(t)$ as follows:

$$m\ddot{y}+c\dot{y}+ky=f_y(t)+f_{thrust} \tag{2}$$

The equations of motion can be nondimensionalized using the free stream velocity $U_\infty$ and the spar diameter D. Define normalized displacements x*, y* and a normalized time t* as $$x^* = \frac{x}{D},\ y^* = \frac{y}{D},\ t^* = \frac{U_\infty t}{D}$$

The equations of motion may be rewritten as:

$$\ddot{x}^* + \left(\frac{4\pi\zeta_s}{U_{red}}\right)\dot{x}^* + \left(\frac{4\pi^2}{U_{red}^2}\right)x^* = \left(\frac{\rho_f D^2}{2m}\right)C_D(t)$$

$$\ddot{y}^* + \left(\frac{4\pi\zeta_s}{U_{red}}\right)\dot{y}^* + \left(\frac{4\pi^2}{U_{red}^2}\right)y^* = \left(\frac{\rho_f D^2}{2m}\right)C_L(t) + \left(\frac{\rho_f D^2}{2m}\right)C_T(t)$$

Here the damping coefficient $z_s$ is defined as:
where $f_n$ is the spar rigid-body sway natural frequency. $U_{red}$ is the reduced velocity $$U_{red} = \frac{U_\infty}{Df_n}$$

which relates the free-stream fluid velocity $U_\infty$ to the structural vibration frequency $f_n$ and the cylinder diameter D. Fluid density is i $\rho_f$. The fluid forces are non-dimensionalized by:

$$C_L = \frac{F_y}{\frac{1}{2}\rho_f U_\infty^2 DL} \text{ and } C_D = \frac{F_x}{\frac{1}{2}\rho_f U_\infty^2 DL}$$

The thrust coefficient is defined similarly as:

$$C_T = \frac{F_{thrust}}{\frac{1}{2}\rho_f U_\infty^2 DL}$$

Thruster 1

$$C_T = -(4.882\ 10^{-2})\dot{y}^* - (1.210\ 10^{-3})y^*$$

Thruster 2

$$C_T = -(3.578)\dot{y}^* - (5.911\ 10^{-1})y^*$$

Reynolds Number Dependence

For a 100-year storm the surface velocities can reach up to 8.4 ft/sec, corresponding to a Reynolds number of 7.4 $10^7$. Given that the computational cost increases substantially with the Reynolds number, it is impossible to carry out simulations at such a high Reynolds number.

Thus, the first step is to examine the sensitivity of the transverse VIV displacement with the Reynolds number. It is known that VIV displacements increase with the Reynolds number, and numerical results have indicated a similar trend.

Figure 4:
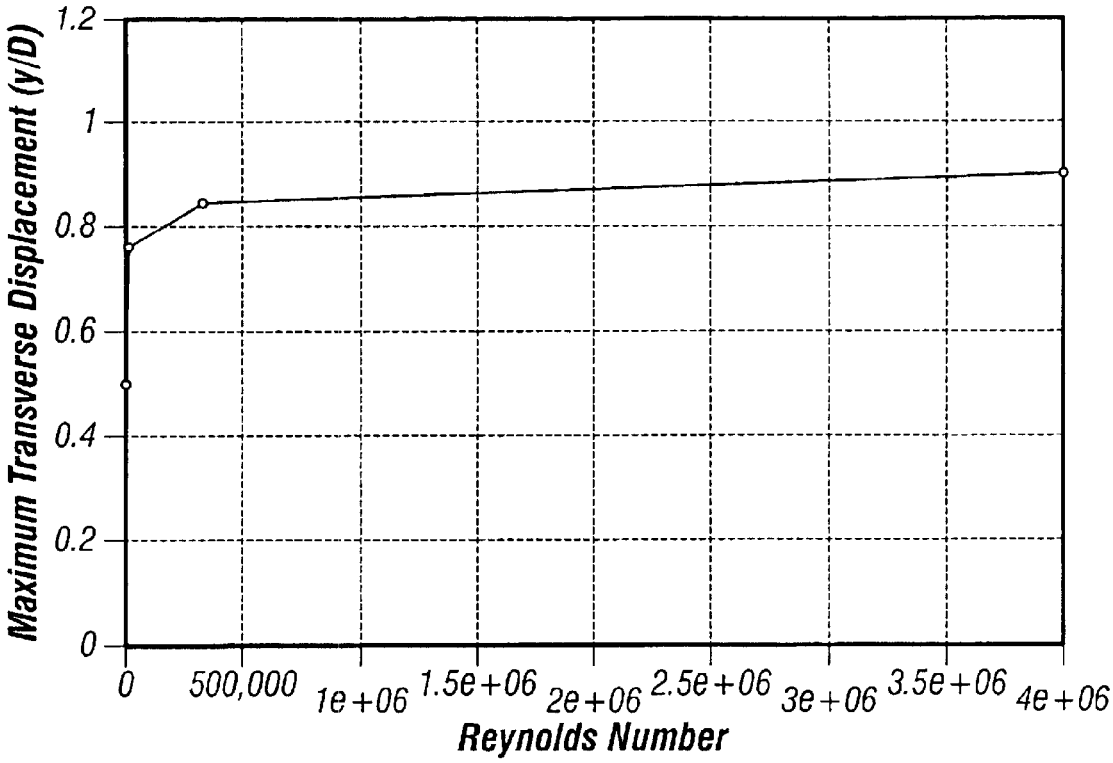
FIG. 4 is a plot of the numerical results of the maximum transverse VIV displacements of the spar as a function of the Reynolds number.

For example, referring now to FIG. 4, there is shown numerical results of the maximum transverse VIV displacements of the spar as a function of the Reynolds number. These results indicate that at first there is a sharp increase of the transverse displacements with the Reynolds number followed by a more gradual increase.

For this Example, simulations were carried out at two different values of the Reynolds number. First numerical simulations were carried out at a subcritical Reynolds number of $10^4$, chosen so that each case would run overnight on a workstation allowing the consideration of a number of different control strategies and configurations.

At the 100-year storm velocities the spar response will be in the lock-in regime, that is, the frequency of the VIV excitation will be the same as the spar natural frequency. In order to have the Reynolds number $10^4$ results exhibit the same behavior, the reduced velocity is chosen such that the spar experiences lock-in (further explained below). The subcritical Reynolds number of $10^4$ results were used to choose the control strategy. In addition, examined were the relative importance of a number of issues, including, the importance of the early detection of the motions, the sensitivity of the motions to the maximum thrust coefficient, and the importance of the buildup of the current over time. A limited number of simulations was performed at a higher Reynolds number of 4.25 $10^5$, in order to determine the power requirements for the thrusters.

Lock-in Regime—Choice of Reduced Velocity

VIV excitation is generally categorized in terms of the reduced velocity, $U_{red}=U_\infty/D\ f_n$, which relates the free-stream fluid velocity $U_\infty$ to the vibration frequency $f_n$ and the cylinder diameter D. In water experiments in the sub-critical Reynolds number range, typical excitation ranges for transverse vibrations occur with reduced velocities in the range of $4.5 \leqq U_{red} \leqq 10$, with the maximum transverse amplitude falling within the range of $6.5 \leqq U_{red} \leqq 8$. Responses in this subcritical range with large displacements occurring in the middle of the lock-in regime are said to exhibit a bell-shaped response pattern.

However, VIV experiments near the critical regime have exhibited less of a bell pattern but very large VIV displacements are still observed within the $6.5 \leqq U_{red} \leqq 8$.

Consequently, to assess the effectiveness of different thruster approaches, a reduced velocity in the middle of the lock-in range was purposefully chosen as a worst-case scenario. The reduced velocity used for all of the thruster control responses presented herein was $U_{red}=6.5$. Note that a reduced velocity of $U_{red}=6.5$ corresponds to a free-stream velocity $U_\infty=5.74$ ft/sec.

Thrust Force Calculation

One of the most critical issues in this modeling is converting the two-dimensional thrust coefficients into a three-dimensional force. The two-dimensional analysis provides a required thrust coefficient $C_T$ as a function of time that will reduce the platform motions. The required thruster force in three dimensions is obtained as follows:

$$F_{thrust} = \frac{1}{2}\rho U_\infty^2 \mathrm{D} C_T L$$

Note that the above equation requires the free-stream velocity $U_\infty$ at each depth in order to obtain the total force.

Figure 5:
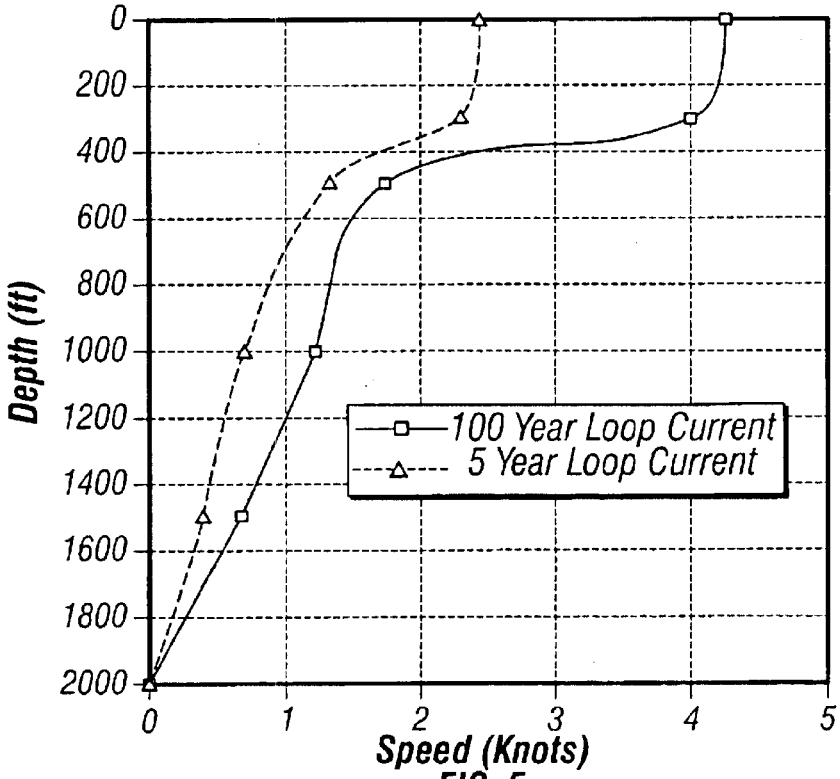
FIG. 5 is a plot of the velocity profiles of the 5 Year and the 100 Year Loop Current Events.

Two different velocity distributions were considered; the 5-year and the 100-year loop-current events. These events were examined to investigate the effect of the variable current profile (velocity changes with depth). Plots of these profiles are given in FIG. 5. In addition to the velocity, the thrust coefficient $C_T$ is also a function of depth.

In this example, two different approaches were adopted. In both approaches the spar is subdivided along its draft into three equal parts. The free-stream velocity $U_\infty$ within each section is assumed constant.

The first approach (assumption A) which is the most conservative, is to assume that the thrust coefficient $C_T$ is constant over the depth. This constant is taken equal to the value of $C_T$ at the free surface (max current). An outline of the entire procedure is presented in FIG. 6 based on a thrust coefficient value $C_T=0.15$.

The second approach (assumption B) is to assume that over the bottom third of the spar the current has decayed to zero. As a result, the bottom third of the spar provides no contribution to the VIV force. In fact, it functions as a damping mechanism, with Morison's equation used to approximate the added mass and damping term of this segment.

Figure 6:
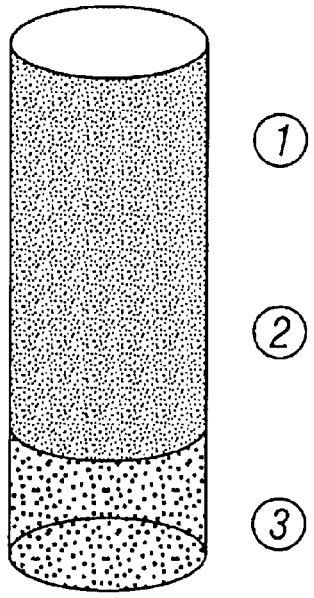
FIG. 6 shows the cylinder having three sections that was used in VIV simulations for an isolated cylinder.

FIG. 6 shows the cylinder having three sections that was used in VIV simulations for an isolated cylinder. The simulation provides a calculation of the required thruster force using a two-dimensional thrust coefficient CT=0.15. For assumption A, it is assumed that all the spar sections have the same thrust coefficient of CT=0.15. The 5 Year Loop Current velocities are scaled up so that the surface velocity is the same as that of the 100 Year Loop Current Event. Table 3 below shows the simulation constants/assumptions. with results shown in Tables 1 and 2 below.

Controller Structure

The effect of the thrusters is included as a dynamic, external-force term in the spar equations of motion. Given the very fast response time of the thrusters, this external-force term can be an arbitrary function of time. Thirteen such functions of time, corresponding to different feedback-control strategies, were considered, and it was concluded that the best strategy is to use a "D" controller, meaning that the thruster output (force on the spar) is proportional to the velocity of the spar. For this example, it was assumed that spar motions could be monitored (and provided to the control computer) by a satellite or other navigational system. It has also been assumed (realistically) that the thrusters possess bounded power (force), and, hence, thruster power supplied will be "clipped" at the maximum available value although the control strategy may suggest that more power would be beneficial. Power equates to cost, and a satisfactory, minimum-cost solution is being sought. In order to avoid using power when it is not needed, the thruster is turned off when the motions fall below a given minimum displacement. Two values of this minimum displacement were used: 5% and 10% of the spar diameter D.

TABLE 1

5 Year Loop Current - Scaled

| Section | Depth (ft) | Velocity (Knots) | Velocity (ft/s) | Reduced Velocity | Unit Thruster Force (lb/ft) | Thruster Force/Section (lbs) | Power HP |
|---|---|---|---|---|---|---|---|
| 1 | 0 | 4.4 | 7.426 | 8.402 | 1027.656 | 222658.841 | 8906.354 |
| 2 | 300 | 4.1184 | 6.951 | 7.864 | 900.325 | 195070.520 | 7802.821 |
| 3 | 500 | 2.3408 | 3.951 | 4.470 | 290.851 | 63017.796 | 2520.712 |
| | | | | | Total Thruster Force | 480747 lbs. | 19230 HP |

TABLE 2

100 Year Loop Current

| Section | Depth (ft) | Velocity (Knots) | Velocity (ft/s) | Reduced Velocity | Unit Thruster Force (lb/ft) | Thruster Force/Section (lbs) | Power HP |
|---|---|---|---|---|---|---|---|
| 1 | 0 | 4.4 | 7.426 | 8.402 | 1027.656 | 222658.841 | 8906.354 |
| 2 | 300 | 4.12 | 6.954 | 7.867 | 901.025 | 195222.12 | 7808.885 |
| 3 | 500 | 1.76 | 2.971 | 3.361 | 164.425 | 35625.415 | 1425.017 |
| | | | | | Total Thruster Force | 453506 lbs. | 18140 HP |

TABLE 3

$F_{Thruster} = \frac{1}{2} \rho U_\infty^2 D C_T L$
Constants/Assumptions

| | |
|---|---|
| Thruster Coefficient, C_T: | 0.15 |
| Sea Water Density, rho [slugs/ft^3]: | 1.988 |
| Spar Diameter, D [ft]: | 125 |

TABLE 3-continued $F_{Thruster} = \frac{1}{2} \rho U_\infty^2 D C_T L$
Constants/Assumptions

| | |
|---|---|
| Spar Draft, L [ft]: | 650 |
| Number of lbs thrust per horsepower: | 25 |
| Natural Structural Frequency, f_n [Hz]: | 7.07E-03 |

Additional Notes:
Results based on VIV simulations using U_red = 6.5 and applying the computed C_T value to all three sections. The given velocity profile was then used to calculate the required thrust forces.

Numerical Results

Example 1

$Re=10^4$

Transverse Motions

Figure 7:
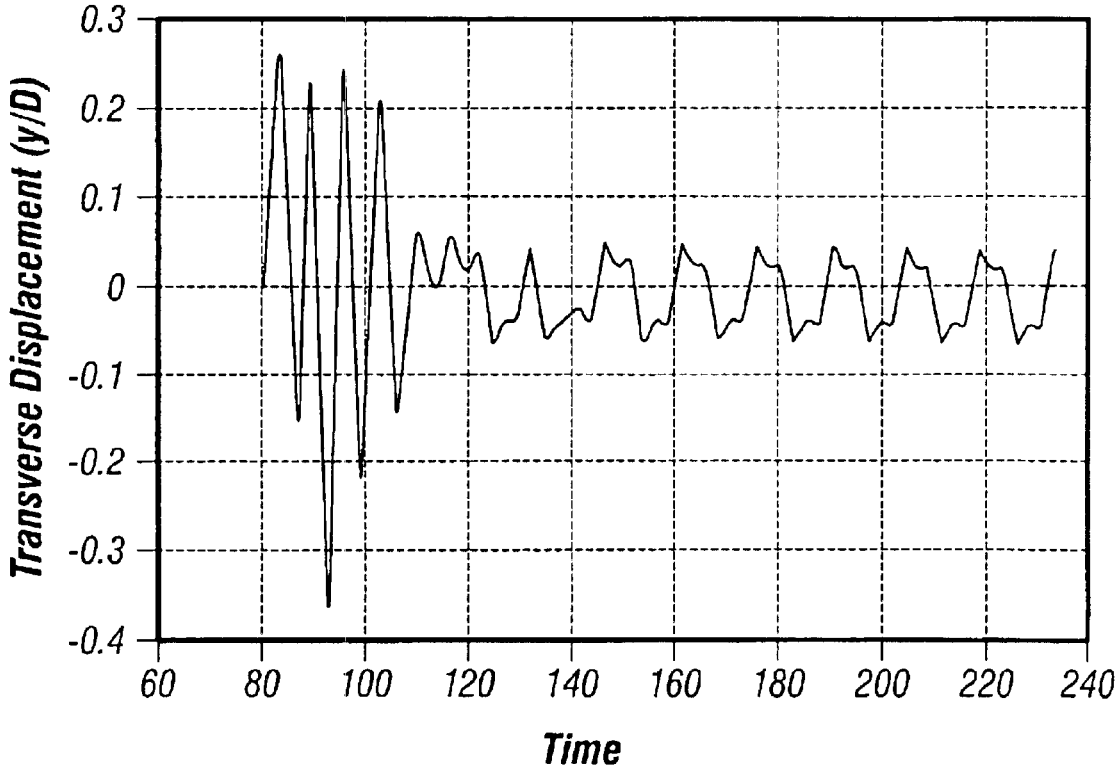
FIG. 7 is a plot of the transverse VIV displacement for the clipped D-controller with the thrust coefficient $(C_T)_{max}$= 0.15.
Figure 8:
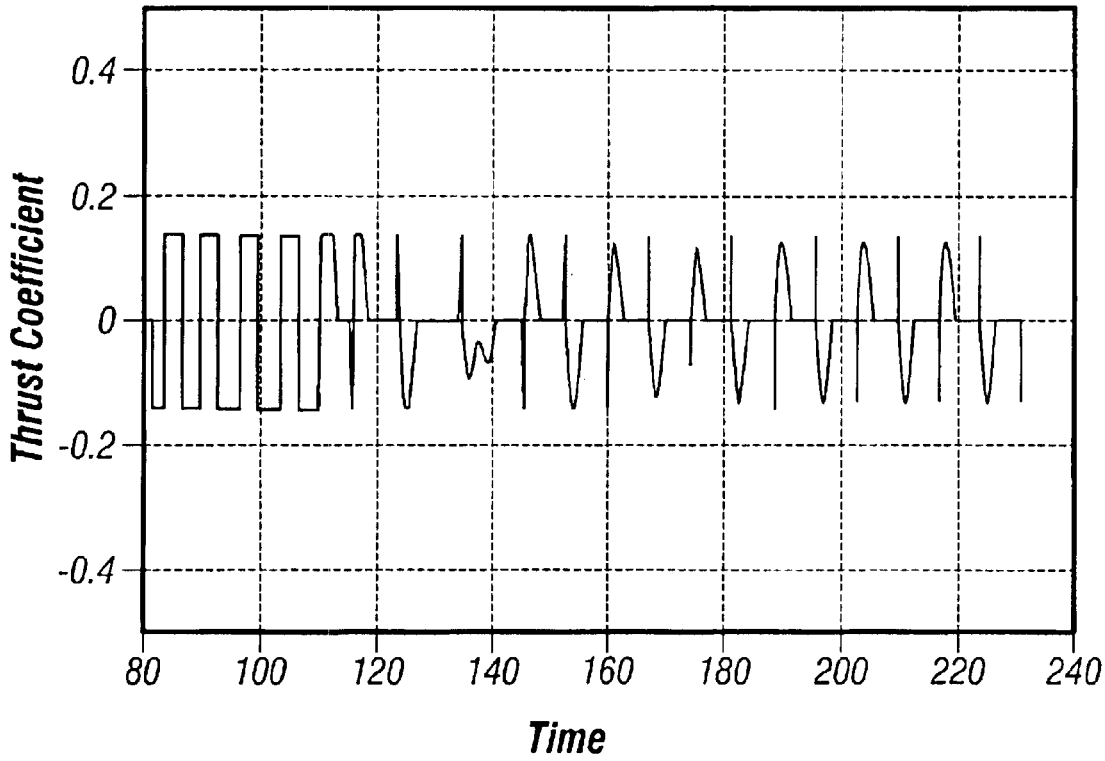
FIG. 8 is a plot of the thruster coefficient history for the clipped D-controller with the thrust coefficient $(C_T)_{max}$= 0.15.

After trial and error, the appropriate maximum value of the thrust coefficient $C_T$ was found to be $(C_T)max=0.15$ (non-dimensionalized). The most conservative assumption (assumption A) was used to convert the thrust coefficient into a three-dimensional force. With this controller, the horizontal motions exhibit maximum transient displacement values equal to 80% of the spar diameter, and steady-state values of around 5% of the diameter. FIG. 7 shows the transverse displacement of the spar as a function of time. The required thrust coefficient $C_T$ as a function of time is shown in FIG. 8. This should be compared to typical steady-state values for spars with helical strakes of around 35% (per Don Allen, Shell). At the outset of this investigation, performance at least comparable to that for straked spars was being sought. For this very complex, nonlinear problem, it was observed that thruster forces (power) necessary to achieve "control" of VIV insured response performance considerably better than that achieved with strakes. In this problem, the steady-state response is of most importance. Therefore, the controller is observed to be very effective in minimizing spar VIV motions. If no control is introduced, spar motions can be as high as 80% of the diameter.

Relief of the In-line Mooring System

One of the detrimental effects of sustaining large VIV motions is that the in-line drag forces increase substantially imposing additional loads on the in-line mooring system. If no control is introduced, the drag coefficient increases from $C_D$=1.2 to an average value of $C_D$=1.75. Note however, that peak values of over $_{CD}$=3 have been observed.

Using the feedback control strategy, the increase in drag forces was reduced significantly when compared to the uncontrolled case. Typical values of maximum drag coefficient are $C_D$=1.6 with steady-state values falling below $C_D$=1.2.

Sensitivity of the Transverse Displacement to the Maximum Thrust Coefficient—Sensitivity to the Shutoff Minimum Value A number of numerical simulations were carried out to assess the sensitivity of the transverse displacement to $(C_T)$ max. These tests were designed to see how small the maximum thrust coefficient could be while still controlling the VIV motions. At the same time, these tests were aimed at identifying what additional benefits might be incurred when larger maximum thrust coefficients were used.

Figure 9:
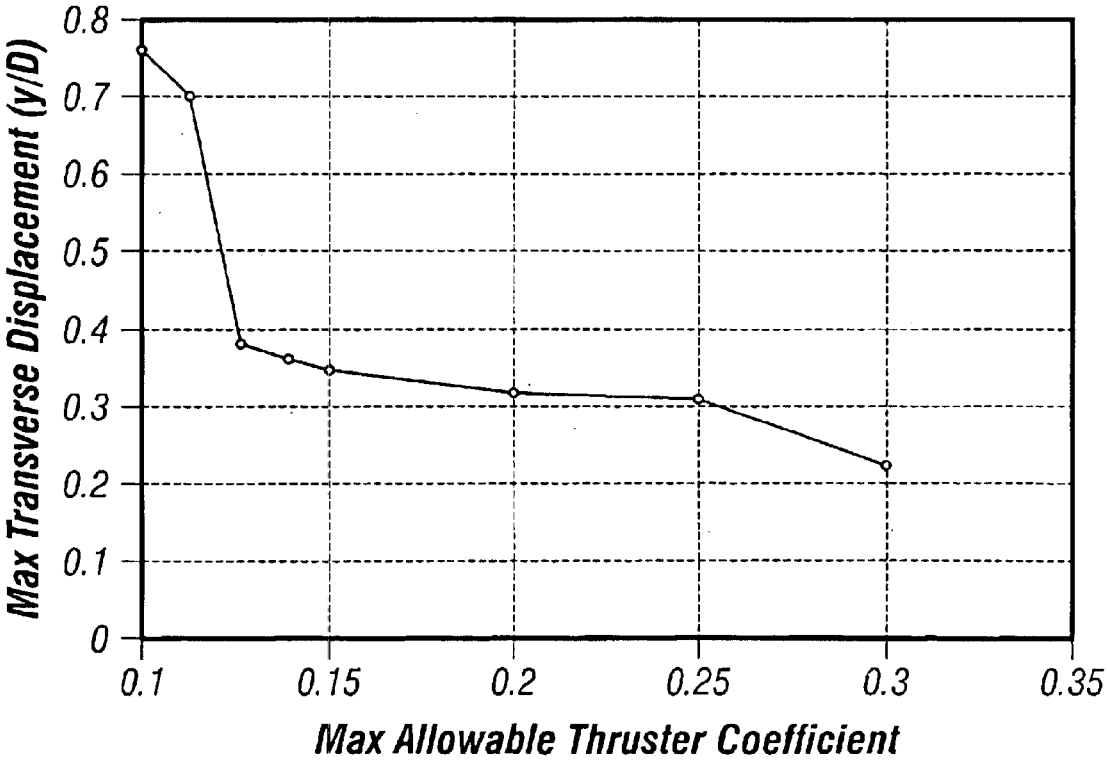
FIG. 9 is a plot of the maximum transient transverse VIV displacement as a function of the max allowable thrust coefficient.

FIG. 9 shows the maximum transient transverse displacement as a function of the maximum allowable thrust coefficient. This FIG. 9 indicates that for $C_T$ values of $(C_T)$max=0.125 and above, the maximum VIV displacements are maintained at values less than 40% of the diameter. However, for $C_T$ below this value the thrusters are unable to adequately control the VIV motions. Note also that as $(C_T)$max is steadily increased, the resulting maximum VIV displacement slowly decreases. For a $(C_T)$max=0.3, the maximum VIV displacement is held below 25% of the diameter.

Figure 10:
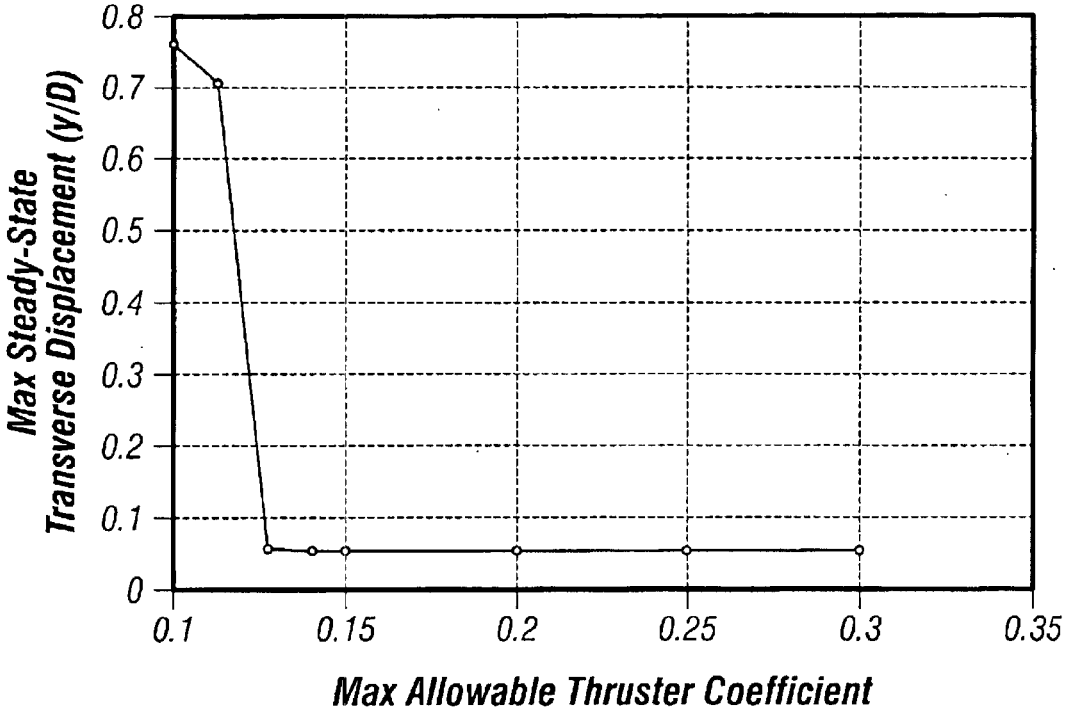
FIG. 10 is a plot of the maximum steady-state transverse VIV displacement as a function of the max allowable thrust coefficient.

FIG. 10 shows a plot of the maximum steady-state displacement as a function of the maximum allowable thrust coefficient. These motions are the most important ones, with FIG. 10 showing that once the thrust coefficient is above the critical value $(C_T)$max=0.125 identical values of the steady-state amplitudes are observed. Therefore any additional power will not make any difference. When the motions are controlled, the steady-state displacements are around 5% of the spar-hull diameter, which is far superior to the performance of passive control devices such as strakes and discontinuous hull geometries.

Next, the possibility of shutting off the controller when the displacements were below a certain minimum value was examined. The objective is to save power and extend the fatigue life of the thruster system. The $(C_T)$max=0.15 controller was used. Two different minimum values were considered: 5% of the spar diameter D and 10% of the spar diameter D. In both cases, the spar motions could be controlled, that is controlling the motions is not affected by setting a shutoff minimum value.

Current Buildup Scenario

Figure 11:
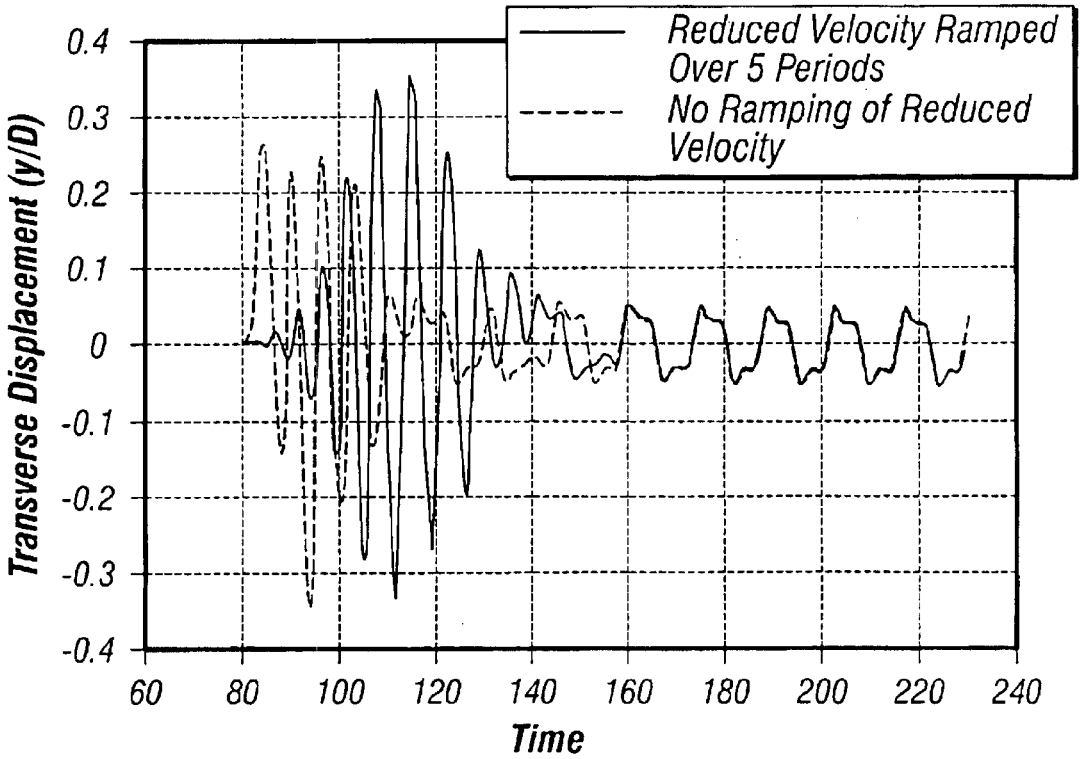
FIG. 11 is a plot of the current build up over five vibration periods—Transverse VIV displacement for the clipped D controller with the thrust coefficient $(C_T)_{max}$=0.15.
Figure 12:
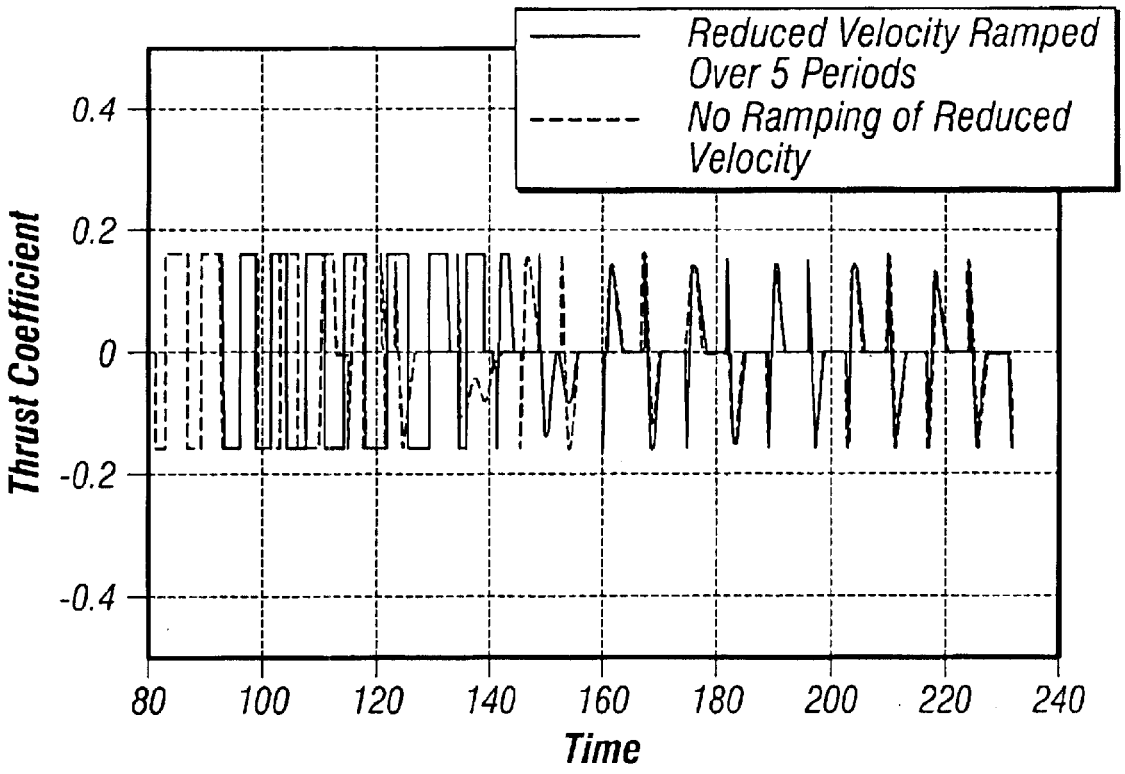
FIG. 12 is a plot of the current build up over five vibration periods—Thrust coefficient history for the clipped D controller with the thrust coefficient $(C_T)_{max}$=0.15.

All simulations thus far were performed under the assumption that the current is applied impulsively to the structure. This section examines the more realistic scenario of the current building up over time. The reduced velocity was ramped up to $U_{red}$=6.5 over approximately five spar-vibration periods. Results were obtained for this case and compared to the case with no ramping of the current velocity. In both cases, (numerical simulations), motion detection and "corrective" thruster forcing occurred instantaneously. FIG. 12 provides a comparison of the thrust coefficient histories for the cases of impulsively applied and ramped currents. The displacement-history plots are shown in FIG. 11, which show that ramping the current velocity changes the VIV response and the largest of the VIV amplitudes occurs later than the case with no ramping. However, the value of the largest displacement remains constant at approximately 35% of the spar diameter. The steady-state displacements are almost identical indicating that the current build-up affects only the transient response.

Delayed Detection Scenario

Next a delayed detection scenario was examined in which the thruster is not activated immediately but with some delay. This case is important because in most real-life situations the motions will not be detected, or properly interpreted, instantly, but rather with some time lag.

Figure 13:
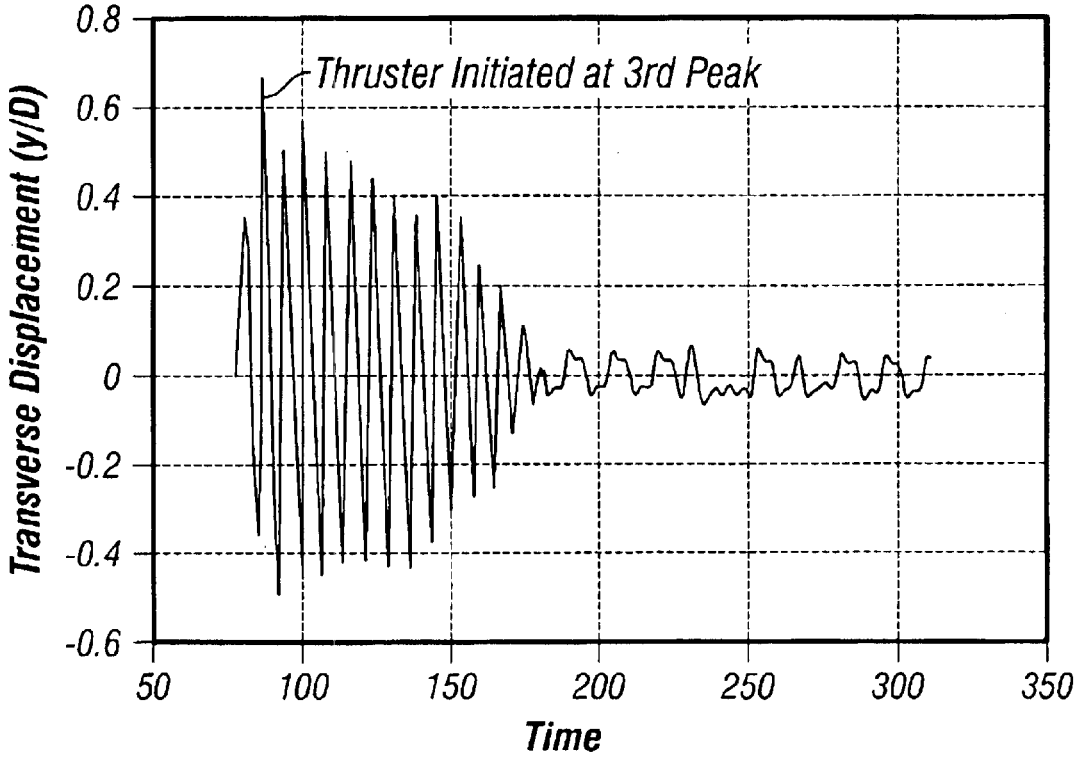
FIG. 13 is a plot of the delayed detection until $3^{rd}$ peak—Transverse VIV displacement for the clipped D controller with the thrust coefficient $(C_T)_{mx}$=0.15.

Different delayed-detection scenarios were examined with the thruster being activated after the 1st, 3rd, 5th and 9th amplitude peaks. The controller with $(C_T)$max=0.15 was capable of controlling the motions with a delayed start up to the 3rd amplitude peak. FIG. 13 shows the VIV displacement results for the 3rd amplitude detection scenario, and shows that once the thruster is initiated at the 3rd vibration peak, the VIV displacements are slowly reduced to a steady-state amplitude smaller than 10% of the diameter.

The numerical simulations were repeated with the controller initiated at the 5th vibration peak. In this case, the steady state displacements are 50% of the spar diameter indicating that the thruster is unable to control the motions.

The thrust coefficient was next increased to $(C_T)$max=0.2. Two different late-detection scenarios were considered with the thrust coefficient activated at the (1) $5^{th}$; and (2) 9th vibration peak. In both cases, the thruster is able to overcome the large VIV motions and controls the motions.

As a conclusion, early detection is very important for successfully controlling the motions. If the motions are detected late, extra thruster power must be available to overcome the large VIV displacements.

Example 2

Re=4.25 $10^5$

The numerical simulations as discussed above were repeated at a Reynolds number Re=4.25 $10^5$. This Reynolds number was chosen because of the availability of earlier experimental results. It was found that the thruster configuration with $(C_T)$max=0.15 was unable to control the motions. The simulations were repeated with a larger $(C_T)$ max ($(C_T)$max=0.3) and in this case the thruster was able to adequately control VIV motions. In these simulations, the more conservative assumption A was used, that is the thrust coefficient was assumed constant over the spar depth.

Figure 14:
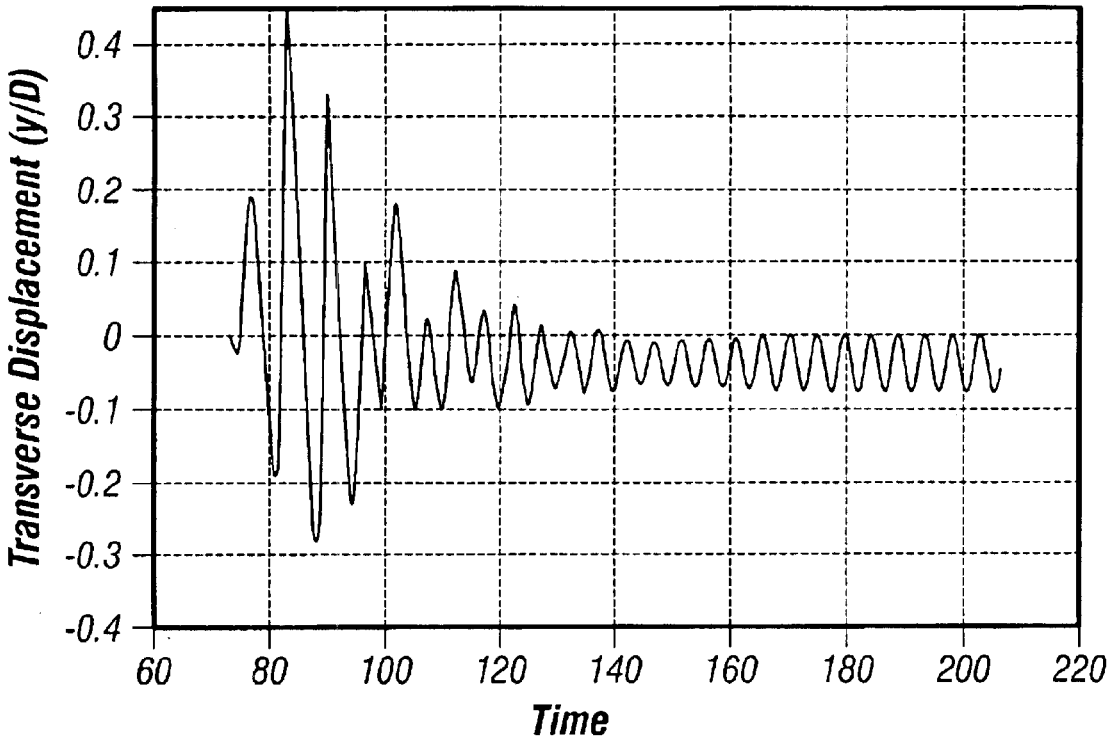
FIG. 14 is a plot of transverse VIV displacement for the clipped D-controller with the thrust coefficient $(C_T)_{max}$= 0.15. Assumption B was used to find the thruster force.
Figure 15:
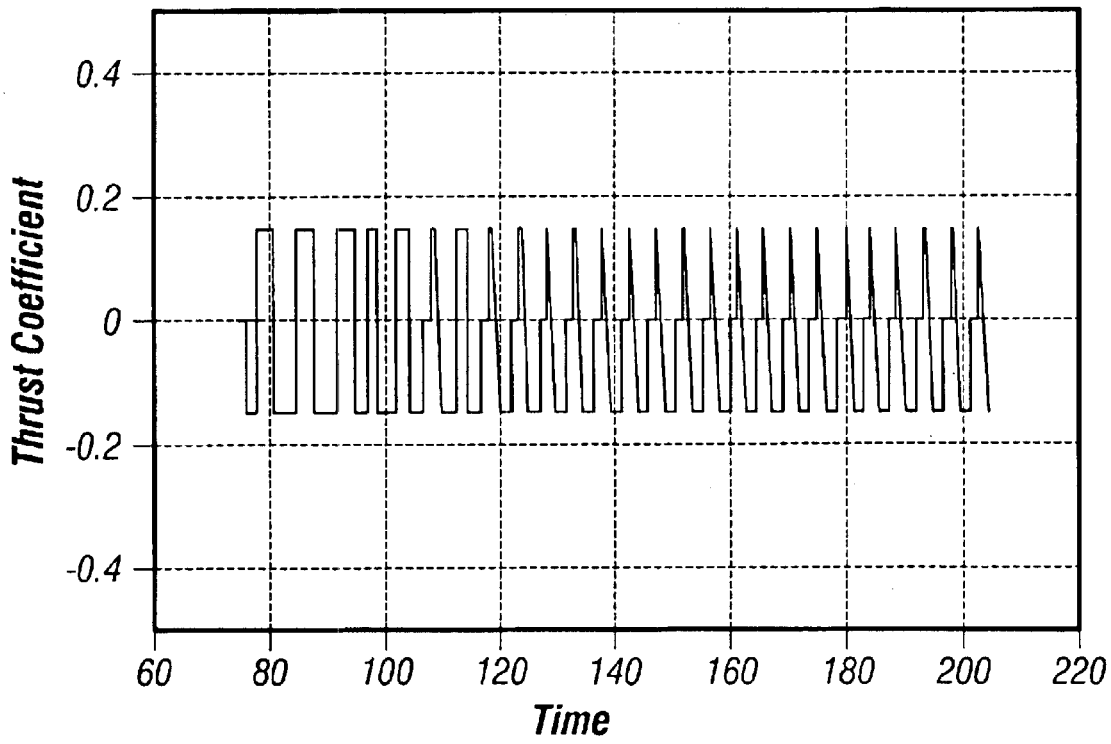
FIG. 15 is a plot of thruster coefficient history for the clipped D-controller with the thrust coefficient $(C_T)_{max}$= 0.15. Assumption B was used to find the thruster force.

The same case was repeated under assumption B, as stated earlier, that over the bottom third of the spar the current has decayed to zero therefore the bottom third of the spar contributes no VIV force and acts as a damping mechanism. Under this assumption, the thruster configuration with $(C_T)$ max=0.15 was able to control the motions with steady-state amplitudes around 8% of the spar diameter. The transverse displacement histories and thrust coefficient histories for this case are shown in FIGS. 14 and 15.

Conclusions from Examples 1 and 2

Of the four different classes of controllers modeled: D-Controllers (proportional differential); Modified D-Controllers; Logic-Based Controllers; and Clipped D-Controllers, the clipped D-controller was preferred.

This clipped D-controller included logic for clipping the thrust output to a predetermined maximum value and for shutting down the thruster when the vibrations were below a certain minimum threshold.

The numerical simulations were performed at two different Reynolds numbers. The numerical results from the Re=$10^4$ simulations indicate that the spar VIV motions can be controlled with a thrust coefficient value $(C_T)$max=0.15.

A number of additional numerical experiments were then carried out at this Reynolds number. Some of the different issues identified and explored include: Current Buildup Scenario; Delayed Motion Detection Scenario; Controller Performance-Sensitivity to Maximum Thruster Value, and Sensitivity to Shutoff Minimum Value.

The results from the numerical simulations indicate that once the maximum thrust coefficient is above a certain critical value, the thruster is able to control the motions and the steady-state amplitudes are acceptable. Therefore any additional power will not make any difference. When the motions are controlled, the steady-state displacements are around 5% of the spar-hull diameter, which is far superior to the performance of passive control devices such as strakes and spar-hull geometry discontinuities.

It is also possible to turn off the thrusters when the spar motions fall below a certain threshold. It was found that turning off the thrusters does not have any adverse effect on the ability of the thrusters to control the spar motions.

Early detection of the motions is very important for successfully controlling spar VIV. If the motions are detected late, extra thruster power must be available to overcome the large VIV displacements. The conclusion from the current buildup numerical examples is that the initial spar response is affected by how fast the current builds up. However the steady-state response of the spar appears to be rather insensitive to the current build up. The performance of the thruster is not sensitive to shutting it off for periods of time where the spar response falls below a certain minimum value.

Additional simulations were performed at a Reynolds number Re=4.25 $10^5$, showed the thruster configuration with $(C_T)$max=0.15 was unable to control the motions when the more conservative assumption A was used to convert the two-dimensional thrust coefficients into a three-dimensional force. When the same controller logic was used with $(C_T)$max=0.30, the thruster was able to successfully control VIV motions. When assumption B was used, the controller with $(C_T)$max=0.15 was able to control the motions.

One obvious conclusion from these results is that three-dimensional effects are very important. In order to represent the hydrodynamic forces and structural interaction of the platform in a sheared current, it would be necessary to utilize a three-dimensional Navier-Stokes method.

It is believed that assumption B is closer to the full three-dimensional problem, while assumption A is too conservative. This may be estimated from FIG. 5 where the current velocity distribution for both the 5-year and 100-year events is shown. In both cases, the current velocity decays very rapidly with depth. As a result, at the bottom third of the spar the current velocity is much smaller when compared to the velocities on the free surface. In fact the power requirements for the thruster with $(C_T)$max=0.30 are too extreme for VIV suppression. They are more of the order of magnitude of the thruster power that would be required for dynamic positioning of the spar. In this report the value $(C_T)$max=0.15 was used to select the thruster system for stabilizing the spar and for estimates of the power required and the total cost of the system.

Proposed Thrusters

If 3000-hp units are used, the number of units required is: 16,196/3,000=6 units (in each direction), plus one (1) unit added for redundancy, for a (both direction) total of 14–3000-hp nozzle thrusters. To place 4 at each depth, two units must be added to make a number divisible by 4, giving a total of 16–3000-hp nozzle thrusters. The four groups of 4 thrusters are spaced 90-deg apart for a total of 16 thrusters.

If 4000-hp units are used, the number of units required is: 16,196/4000=4 units in each direction, plus one (1) for redundancy, then one obtains 5 units in each direction, that is a total of 10–4000-hp nozzle thrusters. Two units must be added to make a number divisible by 4, giving a total of 12–4000-hp nozzle thrusters. This leads to 3 groups of 4 thrusters each for a total of 12 thrusters. FIG. 16 shows the proposed 4000-hp arrangement on the spar. The propeller diameter of a 4000-hp unit is 3.3 m.

There can be interaction between two thrusters at two different depths one being on top of the other if their vertical distance is less than two diameters. Given that the propellers may be deployed up to a depth of 25 m, in the proposed arrangement of FIG. 16 (as well as in the arrangement of 3000-hp units) there is no interference.

While the present invention has been illustrated mainly by reference to a TLP and a spar, it should be understood that the present invention is not to be so limited and finds utility in a wide variety of applications, including but not limited to ship hulls, semi-submersibles, FPSOs, and even to risers.

Also, even though VIV was extensively examined in the described models, the invention should be equally effective (both technically and economically) in the mitigation and/or control of low-frequency drift oscillations of moored vessels due to random-wave excitation, and low-frequency wind-induced motions.

Furthermore, while the present invention has been illustrated mainly by reference to a marine environment, non-limiting examples of which include fresh and saltwater and flowing and non-flowing bodies of water such as oceans, seas, gulfs, rivers, lakes, lochs, streams, ponds, or estuaries. it should be understood that the present invention is not to be so limited and finds utility in a wide variety of other environments, including air or other gases.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which this invention pertains.

I claim:

1. A method for protecting an offshore marine member from vibration caused by a current flowing past said member at a current velocity, wherein said member comprises one or more variable thrust thrusters, the method comprising:

(a) monitoring the current velocity and the marine member for displacement; and (b) activating at least one of the thrusters and varying the thrust as a function of the current velocity and marine member displacement, wherein the activating of step (b) is carried out sufficient to reduce the vibration of the marine member as the vibration is occurring.

2. A method for protecting an offshore marine member from vibration caused by a current flowing past said member at a current velocity, wherein said member comprises one or more variable thrust thrusters, the method comprising:

(a) monitoring the current velocity and the marine member for displacement; and (b) activating at least one of the thrusters and varying the thrust as a function of the current velocity and marine member displacement, wherein the activating of step (b) is carried out in a manner sufficient to prevent vibration of the marine member before the vibration begins.

3. A method for protecting a moored vessel from low frequency oscillations caused by waves or wind striking the vessel, wherein the vessel comprises one or more variable thrust thrusters, the method comprising:

(a) monitoring the vessel for displacement; and (b) activating at least one of the thrusters and varying the thrust as a function of the vessel displacement, wherein the activating of step (b) is carried out sufficient to reduce the vibration of the marine member as the vibration is occurring.

4. A method for protecting a moored vessel from low frequency oscillations caused by waves or wind striking the vessel, wherein the vessel comprises one or more variable thrust thrusters, the method comprising:

(a) monitoring the vessel for displacement; and (b) activating at least one of the thrusters and varying the thrust as a function of the vessel displacement, wherein the activating of step (b) is carried out in a manner sufficient to prevent vibration of the marine member before the vibration begins.

5. An apparatus for protecting an offshore marine member from vibration caused by a current flowing past said member at a current velocity, the apparatus comprising:

(a) one or more variable thrust thrusters positioned to provide thrust to the member;

(b) a displacement sensor positioned to monitor displacement of the member;

(c) a current velocity sensor positioned to monitor the current velocity; and (d) logical controller in communication with the displacement sensor and the current velocity sensor, and in communication with the one or more thrusters, wherein the controller includes instructions for generating a thruster control signal for the thruster to vary the thrust as a function of the velocity and displacement, wherein the logical controller is a proportional- differential type of controller, and wherein the logical controller further includes logic for shutting down the thruster when the oscillation is below a minimum value.

6. The apparatus of claim 5, wherein the offshore marine member is a spar.

7. The apparatus of claim 5, wherein the marine member is a floating vessel.

8. The apparatus of claim 5, wherein the marine member is a tension leg platform.

9. The apparatus of claim 5, wherein the marine member is a riser.

10. An apparatus for protecting a moored vessel from low frequency oscillations caused by waves or wind striking the vessel, the apparatus comprising:

(a) one or more variable thrust thrusters positioned to provide thrust to the vessel;

(b) a displacement sensor positioned to monitor displacement of the vessel; and (c) a logical controller in communication with the displacement sensor and in communication with the one or more thrusters, wherein the controller includes instructions for generating a thruster control signal for the thruster to vary the thrust as a function of displacement, wherein the logical controller is a proportional- differential type of controller, and wherein the logical controller further includes logic for shutting down the thruster when the oscillation is below a minimum value.

11. An apparatus for protecting a moored vessel from low frequency oscillations caused by waves or wind striking the vessel, the apparatus comprising:

(a) one or more variable thrust thrusters positioned to provide thrust to the vessel;

(b) a displacement sensor positioned to monitor displacement of the vessel; and (c) a logical controller in communication with the displacement sensor and in communication with the one or more thrusters, wherein the controller includes instructions for generating a thruster control signal for the thruster to vary the thrust as a function of displacement, wherein the logical controller is a proportional- differential type of controller, wherein the logical controller further includes logic for shutting down the thruster, when the oscillation is below a minimum value, and wherein the logical controller further includes logic for limiting the thrust to a maximum value.

12. The method of claim 1, wherein the activating of step (b) is carried out by providing instructions to the thrusters relating to at least one selected from the group consisting of timing of the activating, length of activating, force of activated thrust, and identity of activated thrusters.

* * * * *